US010843911B2

(12) United States Patent
Walther

(10) Patent No.: US 10,843,911 B2
(45) Date of Patent: Nov. 24, 2020

(54) LIFTING APPARATUS

(71) Applicant: Siemens Aktiengesellschaft, Munich (DE)

(72) Inventor: Steven Walther, Saalfeld (DE)

(73) Assignee: Siemens Aktiengesellschaft, Munich (DE)

( * ) Notice: Subject to any disclaimer, the term of this patent is extended or adjusted under 35 U.S.C. 154(b) by 216 days.

(21) Appl. No.: 15/757,206

(22) PCT Filed: Aug. 31, 2016

(86) PCT No.: PCT/EP2016/070457
§ 371 (c)(1),
(2) Date: Mar. 2, 2018

(87) PCT Pub. No.: WO2017/037085
PCT Pub. Date: Mar. 9, 2017

(65) Prior Publication Data

US 2018/0273362 A1 Sep. 27, 2018

(30) Foreign Application Priority Data

Sep. 4, 2015 (EP) ..... 15183810

(51) Int. Cl.
*B66F 7/06* (2006.01)

(52) U.S. Cl.
CPC ..... *B66F 7/0691* (2013.01); *B66F 7/065* (2013.01); *B66F 7/0658* (2013.01)

(58) Field of Classification Search
CPC ..... B66F 7/06; B66F 7/0658; B66F 7/0691; B66F 7/0641; B66F 3/00; B66F 3/22; B66F 3/46
(Continued)

(56) References Cited

U.S. PATENT DOCUMENTS 2,132,343 A 10/1938 Jarrett
4,600,095 A * 7/1986 Brems ..... B30B 1/14 198/346.2
(Continued)

FOREIGN PATENT DOCUMENTS

CN 103011013 4/2013
DE 20209407 7/2003
(Continued)

*Primary Examiner* — Tyrone V Hall, Jr.
(74) *Attorney, Agent, or Firm* — Cozen O'Connor

(57) ABSTRACT

A lifting apparatus for an industrial processing station, i.e., a lifting table for conveying a body shell during series production of motor vehicles, wherein the lifting apparatus conveys a workpiece on a top frame moved in a purely vertical direction, where the lifting apparatus has, as first vertical guide, at least one isosceles slider-crank mechanism actuated by a motorized drive element, where the isosceles slider-crank mechanism, which consists of a fixed-bearing swing arm with a swing-arm bearing thereof, a control arm with a control-arm guide, a control-arm central joint and a fixed-bearing joint connected to the top frame, is configured to move via actuation of the tie rod acting on the fixed-bearing swing arm, and where particular use of an isosceles slider-crank mechanism, which is also known literature as a "Scott-Russell mechanism", provides a simple and effective vertical guide system that allows low overall heights with a minimum production outlay.

3 Claims, 2 Drawing Sheets

(58) Field of Classification Search
USPC ..... 248/155.2; 254/89 R, 10 R, 10 B, 10 C, 254/122, 124, 8 B, 93 L, 91
See application file for complete search history.

(56) References Cited

U.S. PATENT DOCUMENTS

| | | | | |
|---|---|---|---|---|
| 4,886,145 | A | 12/1989 | Iwahashi | |
| 7,413,056 | B2 * | 8/2008 | Gonzi | B66F 7/065 187/269 |
| 8,052,122 | B2 * | 11/2011 | Rossato | B66F 7/0641 254/124 |
| 2012/0241698 | A1 * | 9/2012 | Swasey | B66F 3/22 254/122 |

FOREIGN PATENT DOCUMENTS

| | | | |
|---|---|---|---|
| DE | 102008036288 | | 2/2010 |
| EP | 2719653 | | 4/2014 |
| EP | 2719653 | A1 * | 4/2014 |
| FR | 2912393 | | 8/2008 |
| GB | 2179016 | | 2/1987 |
| JP | S53165591 | | 12/1978 |
| JP | S56122798 | | 9/1981 |

* cited by examiner

LIFTING APPARATUS

CROSS-REFERENCE TO RELATED APPLICATIONS

This is a U.S. national stage of application No. PCT/EP2016/070457 filed 31 Aug. 2016. Priority is claimed on European Application No. 15183810 filed Sep. 4, 2015, the content of which is incorporated by reference.

BACKGROUND OF THE INVENTION

1. Field of the Invention

The invention relates to a lifting apparatus for an industrial processing station.

2. Description of the Related Art

The available technology in the field of lifting technology is wide-ranging and offers extremely different implementation models depending on the application. In particular, the high demands placed on the reliability of a lifting apparatus in rough production environments, as may be found, for example, in welding stations of an automotive production line, demand preferably simple and robust system solutions. This particularly relates to lifting platforms that are used in series production of motor vehicles for vertically conveying bodies-in-white to processing stations.

The prior art includes lifting apparatuses having one or more isosceles slider crank mechanisms for guiding a vertically movable load-bearing member, where the structure and use thereof differ from each other.

CN 103011013 A describes a lifting apparatus having two load-bearing lifting elements that are formed as swing arms and an isosceles slider crank mechanism. In this instance, load-bearing member is supported on the two swing arms via the guides thereof. As a result of the isosceles slider crank mechanism that is connected to the load-bearing member, a horizontal displacement of the load-bearing member is thus prevented. The vertical lifting movement is consequently converted only by the two swing arms. Consequently, only the horizontal forces originating from the load-bearing member are taken up by this isosceles slider crank mechanism. In addition to the structural space that is intended to be provided for the swing arms, structural space must additionally be reserved for the isosceles slider crank mechanism.

EP 2 719 653 A1 describes a lifting platform that can be adjusted in terms of height in a motorized manner in a vertical direction for use in bodywork construction of the automotive industry and which has two isosceles slider crank mechanisms that are movable with lifting in a vertical direction, where the support levers of the isosceles slider crank mechanisms are connected at one end to the link elements and at the respective other end to a pivot shaft of a gear mechanism. Both gear mechanisms are driven synchronously via a cardan shaft. Between the load-bearing member and a base frame, there are indirectly supported (where applicable) two pressure spring elements that have resilient pretensioning and that absorb a considerable portion of the weight transferred from the load-bearing member to the link elements.

However, it must be evaluated from case-to-case in what relationship the weight of the load-bearing member behaves with respect to the weight of the transport goods, to what extent the gear mechanism size is influenced by the pressure spring elements and whether the additional production complexity that must be involved in the production of two pressure spring elements and the connection locations thereof is economically viable. This construction type requires two gear mechanisms that are complex to produce and that have a high transmission ratio and that must apply a correspondingly high torque to vertically move the load-bearing member with transport goods via the isosceles slider crank mechanism.

FR 2 912 393 A1 describes a lifting apparatus in which a load-bearing member moves in a vertical direction by at least one swing arm that engages on the load-bearing member being activated. In this instance, a vertical guiding system that is constructed as a fixed bearing is not directly connected to the drive train that activates the swing arm or swing arms.

With the use of only one swing arm, the vertical guiding system of the fixed bearing is intended to be constructed in a very flexurally resistant and torsion-resistant manner because alone this system must prevent the tilting of the load-bearing member about the articulation location of the swing arm guide and thus retain the load-bearing member with the transport goods horizontally in balance. When conveying the transport goods from station to station, as is the case in automotive production lines, as a result of the uneven load distribution, a high tilting moment about the articulation location of the swing arm guide would be produced, which can readily lead to an undesirable sagging of the ends of the load-bearing member. The addition of a second or even third swing arm that is connected to the drive train and/or an additional vertical guiding system may increase the tilting stability of this system to a large degree but also significantly increases the production complexity.

JP S53165591 U relates to a lifting apparatus having an isosceles slider crank mechanism as a vertical guide that is moved by actuating a pulling mechanism that acts on the link guide that is guided in a straight manner. A connection between the movable bearing and the isosceles slider crank mechanism as a fixed bearing is produced by a pulling mechanism that also acts on the link guide. This linear movement, which is transmitted from the link guide to the pulling mechanism, is converted by a complex movable bearing into a vertical lifting action. The movable bearing is composed of three support elements that are connected to each other by means of articulations, where the upper support element that is in contact with the load-bearing member is guided in a linear manner and the lower support element constitutes a lever that is contacted in a pivotably movable manner via an axis with a support that is secured to the base. In this instance, the central support element acts only as a connection element. The linear movement of the pulling means can be converted via a toothed rod unit into a rotation movement on the axis of the lower support element. The vertical lifting height is also determined by the length of the pivotably movable lever, which together with the support element that is guided in a linear manner acts in an unfavorable manner on the structural height of the lifting apparatus.

SUMMARY OF THE INVENTION

In view of the foregoing, it is therefore an object of the present invention to provide a lifting apparatus that enables low structural heights and is attractive in economic terms particularly as a result of its simplicity.

This and other objects and advantages are achieved in accordance with the invention by a lifting apparatus for an industrial processing station, in particular a lifting platform for conveying a body-in-white in motor vehicle series production, where the lifting apparatus is constructed to convey a workpiece on an upper frame which is moveable in a purely vertical direction. In this instance, the lifting apparatus has an isosceles slider crank mechanism that is actuated with a motorized drive element as a first vertical guide. Here, the isosceles slider crank mechanism which comprises a fixed bearing swing arm with the swing arm bearing thereof, a link with the link guide thereof, a link center articulation and a fixed bearing articulation that is connected to the upper frame is constructed such that it is moved by actuating the pulling rod that engages on the fixed bearing swing arm. In particular, as a result of the use of an isosceles slider crank mechanism that is also known in literature as a "Scott-Russell mechanism", a simple and effective variant of a vertical guiding system that enables small structural heights with minimal production complexity is achieved. As a result of the small number of lifting elements that are involved in the vertical lifting and as a result of the possible simple configuration of these lifting elements in technical production terms, in comparison with the prior art the system complexity can be minimized and consequently significant advantages can be achieved. These include a flat, compact and robust construction, a simple and cost-effective production, a high installation availability, low wear and minimal maintenance and servicing expenditure. Precisely these features are of significant importance in motor vehicle series production.

Advantageously, at least a second vertical guide is provided to achieve a high mechanical stability, where a movable bearing swing arm may be provided in a particularly advantageous manner as the second vertical guide. In this instance, the second vertical guide is also advantageously activated by the same motorized drive element as the first one.

Advantageously, at least two second vertical guides that are arranged parallel with each other may also be provided with coaxial arrangement of the articulations. In an advantageous embodiment, the first and second vertical guides are connected to each other in this case for synchronized vertical movement via a pulling rod and preferably the motorized drive element is connected by a drive rod via one of the vertical guides to the pulling rod.

A small structural height is produced by the motorized drive element being arranged in a horizontal direction outside a base face that is covered by the upper frame.

As a result of the simplicity, robustness and the ease of maintenance and servicing, a cam drive disk is preferably used together with a synchronous or asynchronous geared motor, where it preferably has a mechanical holding brake.

The required torque of the drive and the loading of the load-guiding elements may advantageously be further reduced by at least one mass compensation system being provided. In this instance, the mass compensation system may comprise as an energy store a mechanical spring, a pneumatic or hydropneumatic storage device.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

An embodiment of the lifting apparatus according to the invention is explained below with reference to the drawings, in which.

DETAILED DESCRIPTION OF THE EXEMPLARY EMBODIMENTS

Figure 1:
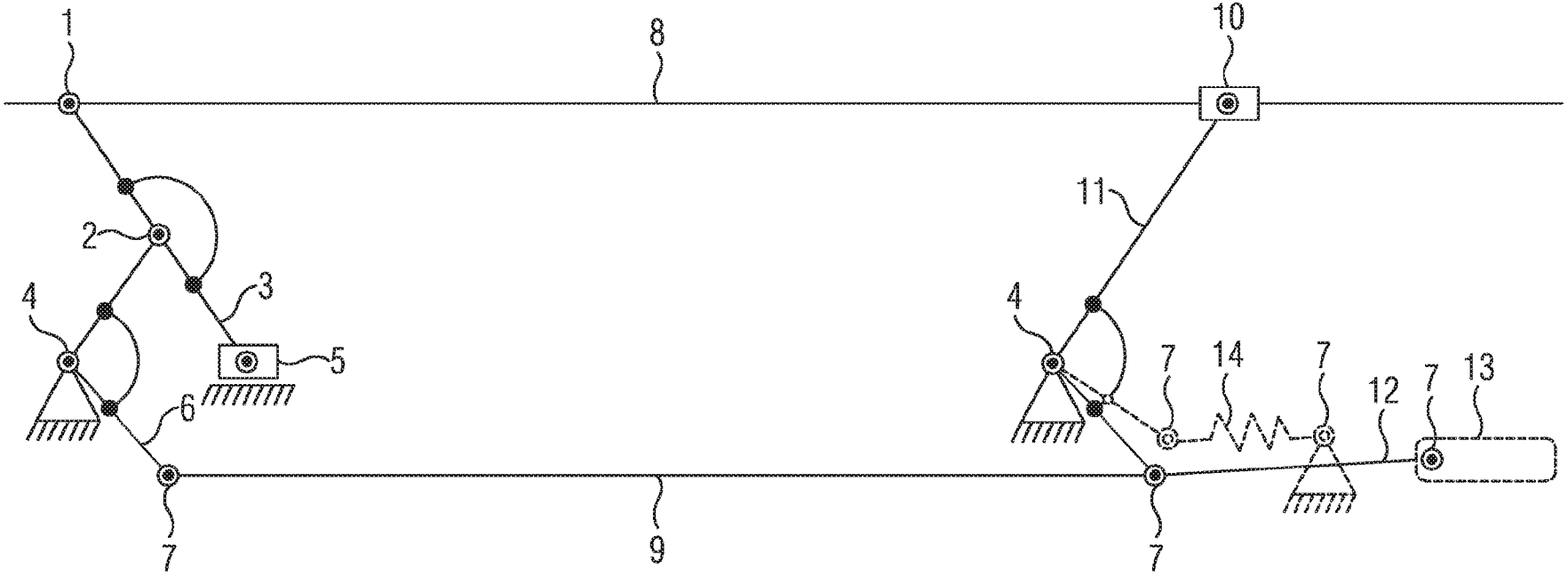
FIG. 1 is a schematic sectioned drawing of a lifting apparatus in accordance with the invention in an upper position.
Figure 2:
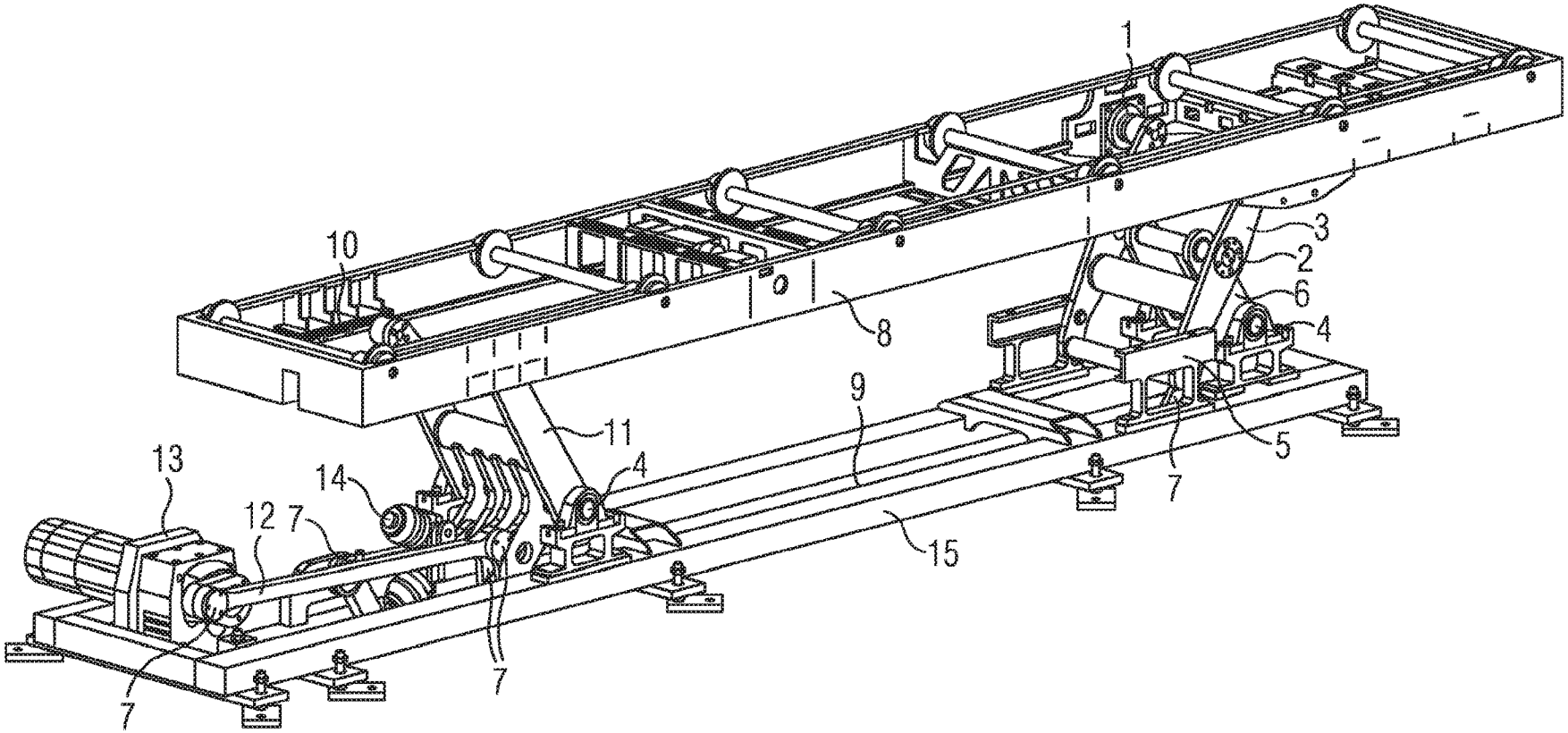
FIG. 2 is a perspective view of an embodiment of the lifting apparatus in accordance with the invention.

In this case, the reference numerals are defined as follows:

| | |
|---|---|
| 1 | Fixed bearing articulation |
| 2 | Link center articulation |
| 3 | Link |
| 4 | Swing arm bearing |
| 5 | Link guide |
| 6 | Fixed bearing swing arm |
| 7 | Bearing location |
| 8 | Upper frame |
| 9 | Pulling rod |
| 10 | Movable bearing guide |
| 11 | Movable bearing swing arm |
| 12 | Drive rod |
| 13 | Drive unit |
| 14 | Mass compensation element |

Depending on the embodiment, the securing of the fixed and movable bearing arrangement together with the drive unit with the mass compensation element can be carried out directly on the foundation or additionally on a common base frame (not illustrated in FIG. 1).

A first vertical guide can be seen in the left half of FIG. 1 and constitutes the secure bearing side of the lifting apparatus. The first vertical guide comprises a link 3 that is connected via the fixed bearing articulation 1 to the upper frame 8 and via a link guide 5 to the base frame, where the upper frame is preferably constructed as a roller conveyor with running rollers for conveying a transport product.

The link in turn interacts via the link center articulation 2 that rests centrally between the fixed bearing articulation 1 and link guide 5 with the fixed bearing swing arm 6. The swing arm bearings 4 in this instance form the rotation location for both the fixed and the movable bearing swing arms 11.

The movable bearing comprises a movable bearing swing arm 11 at the upper end of which there is formed a movable bearing guide 10 that produces the contact with the upper frame. A plurality of bearing locations 7 are provided on the movable bearing swing arm 11, which have a coaxial arrangement relative to the rotation location of the movable bearing swing arm 11. As a result, on the one hand, the connection of the pulling rod 9 that produces a connection to the isosceles slider crank mechanism and, on the other hand, the connection of a drive rod 12 and where applicable an optional mass compensation element 14 to the lever mechanism can be produced.

The active component of the lifting platform in accordance with the invention forms the electromotive drive unit 13. In order to produce the advance movement originating from this electromotive drive unit 13, various technical solutions are available. It is possible to mention at this point linear units in the form of screw, belt and toothed rack drives or lifting rollers but also the cam drive disk that is secured to the geared motor and which has already been mentioned above.

As a result of the simplicity and robustness and the ease of maintenance and servicing, a cam drive disk is preferably used together with a synchronous or asynchronous geared motor, where it has a mechanical holding brake.

Not least as a result of the small number of the lifting elements (1-13) which are involved in the vertical lifting and as a result of the possible simple configuration of these lifting elements in technical productions terms, in comparison with the prior art, the system complexity could be minimized and consequently the following significant advantages are achieved:

flat, compact and robust construction,
simple and cost-effective production,
high installation availability,
low wear, and/or
minimal maintenance and servicing complexity.

Precisely these features are of great significance in motor vehicle series production.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those structures and/or elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A lifting apparatus for an industrial processing station, the lifting apparatus being constructed to convey a workpiece on an upper frame which is movable in a purely vertical direction, the lifting apparatus comprising:

an isosceles slider crank mechanism which is actuated via a motorized drive element arranged at one end of the lifting apparatus, said isosceles slider crank mechanism forming a first vertical guide;

a movable bearing swing arm with a guide thereof forming a second vertical guide which is activated by the same motorized drive element;

wherein the isosceles slider crank mechanism which comprises a fixed bearing swing arm with a swing arm bearing thereof, a link with a link guide thereof, a link center articulation and a fixed bearing articulation which is connected to the upper frame is configured to move via actuation of a pulling rod which engages on the fixed bearing swing arm; and, at least one mass compensation system connected to the movable bearing swing arm.

2. Lifting apparatus as claimed in patent claim 1, wherein the motorized drive element has a cam drive disk for force transmission to the first and second vertical guides.

3. The lifting apparatus as claimed in claim 1, wherein the lifting apparatus is a lifting platform for conveying a body-in-white in motor vehicle series production.

* * * * *